US007569179B2

(12) United States Patent
Fang

(10) Patent No.: US 7,569,179 B2
(45) Date of Patent: Aug. 4, 2009

(54) FUNCTIONALLY GRADED CEMENTED TUNGSTEN CARBIDE

(75) Inventor: Zhigang Zak Fang, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 49 days.

(21) Appl. No.: 11/753,417

(22) Filed: May 24, 2007

(65) Prior Publication Data

US 2007/0214913 A1 Sep. 20, 2007

Related U.S. Application Data

(62) Division of application No. 11/152,716, filed on Jun. 14, 2005.

(60) Provisional application No. 60/579,339, filed on Jun. 14, 2004.

(51) Int. Cl.
*C22C 1/05* (2006.01)
*B22F 3/12* (2006.01)

(52) U.S. Cl. ..... 419/14; 419/38

(58) Field of Classification Search ..... 419/18, 419/30, 47, 10
See application file for complete search history.

(56) References Cited

U.S. PATENT DOCUMENTS 3,660,050 A * 5/1972 Iler et al. ..... 75/240
4,610,931 A 9/1986 Nemeth et al.
4,743,515 A * 5/1988 Fischer et al. ..... 428/698
5,279,901 A 1/1994 Akerman et al.
5,413,869 A * 5/1995 Hartzell et al. ..... 428/469
5,453,241 A 9/1995 Akerman et al.
5,541,006 A 7/1996 Conley
5,549,980 A 8/1996 Ostlund et al.
5,856,626 A * 1/1999 Fischer et al. ..... 75/240
5,880,382 A 3/1999 Fang et al.
6,063,502 A 5/2000 Sue et al.
6,214,079 B1 4/2001 Kear et al.
6,638,474 B2 10/2003 Liu et al.

(Continued)

OTHER PUBLICATIONS

American Society for Testing and Materials ("Standard Test Method for Apparent Porosity in Cemented Carbides", Annual Book of ASTM Standards, 1996).

(Continued)

*Primary Examiner*—George Wyszomierski
*Assistant Examiner*—Tima M McGuthry-Banks

(57) ABSTRACT

The present invention is a method for producing functionally graded materials that contain a hard phase that is embedded in a metal matrix phase. The material have a continuous gradient of a matrix metal phase. An example of these types of materials include functionally graded cemented tungsten carbide (the hard phase) that has a continuous gradient of cobalt (the matrix metal) from one reference position, for example, one surface of a part, to another reference position, for example, the opposite surface of the part or within the part. The functionally graded materials are sintered via a liquid phase sintering (LPS) technique. In order to achieve the desired continuous gradient of the matrix metal, an initial gradient of one of the chemical elements of the hard phase is designed and built into the part prior to liquid phase sintering. The exact gradient of the composition material elements that will be required depends on factors such as the desired final matrix metal gradient, the dimension of the part to be made, and the sintering time and temperature.

11 Claims, 17 Drawing Sheets

U.S. PATENT DOCUMENTS

| | | | | |
|---|---|---|---|---|
| 6,869,460 | B1 * | 3/2005 | Bennett et al. | 75/236 |
| 6,896,460 | B2 | 5/2005 | Enomoto et al. | |
| 7,157,148 | B2 * | 1/2007 | Takai et al. | 428/469 |

OTHER PUBLICATIONS

Miyamoto et al. ("Functionally Graded Materials: Design, Processing and Applications", Book, Kluwer Academic Publishers, 1999).

Put et al. ("Functionally Graded WC-Co Materials Produced by Electrophoretic Deposition", Scripta Materialia 45 (2001) 1139-1145).

Eso et al., University of Utah Department of Metallurgical Engineering; A New Method for Making Functionally Graded WC-Co Composites via Liquid Phase Sintering; paper presented at PM Tec2 conference in Chicago, Illinois, Jun. 2004.

Eso, Oladapo O., University of Utah Department of Metallurgical Engineering; Sintering Studies of Functionally Graded WC-Co Composites; handout distributed at PM Tec2 conference in Chicago, Illinois, Jun. 2004.

Eso et al., University of Utah Department of Metallurgical Engineering; Liquid Phase Sintering of Functionally Graded WC-Co Composites; to appear in Int. J. of Refractory Metals and Hard Materials, 2005.

Office Action issued for U.S. Appl. No. 11/152,716 on Apr. 19, 2007.

Office Action issued for U.S. Appl. No. 11/152,716 on Sep. 13, 2007.

Interview Summary issued for U.S. Appl. No. 11/152,716 on Oct. 23, 2007.

Office Action issued for U.S. Appl. No. 11/152,716 on Dec. 6, 2007.

Office Action issued for U.S. Appl. No. 11/152,716 on Feb. 12, 2008.

Office Action issued for U.S. Appl. No. 11/152,716 on July 9, 2008.

Office Action issued for U.S. Appl. No. 11/152,716 on Dec. 8, 2008.

Interview Summary issued for U.S. Appl. No. 11/152,716 on Feb. 18, 2009.

* cited by examiner

FUNCTIONALLY GRADED CEMENTED TUNGSTEN CARBIDE

CROSS-REFERENCED RELATED APPLICATION

This application is a divisional of U.S. patent application Ser. No. 11/152,716 filed Jun. 14, 2005, which application claims the benefit of U.S. Provisional Application No. 60/579,339, filed Jun. 14, 2004. These prior applications are expressly incorporated herein by reference.

BACKGROUND OF THE INVENTION

The present invention relates to functionally graded materials. Functionally graded material refers to a class of materials that have graded compositions within their microstructure. The graded compositions results in graded mechanical and physical properties and functionality, which may be desirable for commercial applications.

Cemented tungsten carbide is a composite material of tungsten carbide embedded in a cobalt matrix. (Such cemented tungsten carbide materials are often abbreviated as "WC—Co" or "WC—Co materials.") Typical compositions of cobalt metal range from 3 to 30 percent by weight. Unless otherwise specified, the concentrations expressed herein are weight percent amounts. Cemented tungsten carbide materials have unique properties compared to metal alloys or ceramic materials. For example, WC—Co has much higher hardness, wear resistance, and strength than steel alloys, but much lower fracture toughness than steel alloys. When compared to ceramic materials, WC—Co materials have much higher fracture toughness at equivalent or better hardness and wear resistance levels. Because of their unique mechanical properties, cemented tungsten carbide materials are used in a wide range of industrial applications including metal cutting, mining, oil and gas exploration, and many applications requiring extreme wear resistance.

The applications of cemented tungsten carbide are limited, however, by its relatively low fracture toughness. Chipping and fracturing are the leading causes for degradation or premature failures of cemented tungsten carbide tools. In real life engineering applications, one is forced to trade-off between the wear resistance and fracture toughness. In other words, the fracture toughness is improved at the expense of hardness and wear resistance, and vice versa.

It is therefore highly desirable to improve the fracture toughness of cemented tungsten carbide materials while maintaining their superior wear resistance. The approach of "functionally graded materials" is a viable approach for achieving this goal. In a functionally graded cemented tungsten carbide, the cobalt content of the composite is graded from one surface to another surface or from one reference position to another reference position within a part. Because the wear resistance and toughness of WC—Co materials depend on their cobalt content, the cobalt gradient produces graded properties. For example, a component made of WC—Co material may have 6 percent of cobalt on its surface, but the cobalt content increases gradually as a function of the depth from the surface to the interior of the component until it reaches 16% and then it levels off so that the bulk of the component has 16% Co.

A property gradient of WC—Co material may also be achieved by varying tungsten carbide (WC) grain sizes. However, it is very difficult, if not impossible, to vary grain sizes continuously. Therefore, property gradation achieved by varying grain sizes is almost always non-continuous.

Although it is widely recognized that a graded structure as described above is desired, there is to date no satisfactory manufacturing method that produces such materials with continuous gradation.

Cemented tungsten carbide is usually manufactured by liquid phase sintering ("LPS") techniques. Typical sintering temperatures range from 1320° C. to 1460° C. At the sintering temperature, cobalt phase becomes liquid. The formation of liquid is necessary to obtain porosity free materials. The Co liquid phase has a limited solubility for the elements W and C according to the WC—Co ternary phase diagram.

The liquid phase sintering process cannot be used directly for making the WC—Co with graded cobalt compositions because the liquid phase cobalt homogenizes during sintering. Any initial gradient of cobalt content prior to sintering, which can be built-in through various powder compaction and shaping techniques, is eliminated during sintering. The final material is not graded.

A logical approach that has often been proposed is to sinter the material at solid state. But solid state sintering does not fully densify WC—Co material. There is usually >1% by volume of porosity remaining after solid state sintering. Such porosity levels significantly degrade desired mechanical properties, rendering the material unacceptable. It is often suggested to eliminate the remaining porosity by using high pressure consolidation processes such as hot isostatic pressing (HIP) or rapid omnidirectional compaction (ROC). Although it is plausible that these high pressure processes fully densify the materials, they add to manufacturing costs considerably (>40%). In addition, the mechanical properties of materials made by high pressure consolidation processes at solid state are not comparable to those of WC—Co materials made by liquid phase sintering.

In short, neither conventional LPS nor solid state sintering processes satisfactorily produce functionally graded WC—Co with continuous gradation. A new method is required.

Two known patents disclose methods for creating graded compositions in cemented tungsten carbide, namely U.S. Pat. No. 5,541,006 (the "'006 patent) and U.S. Pat. No. 6,896,460 (the "'460 patent"). Both the '006 patent and the '460 patent are expressly incorporated herein by reference. However, the methods disclose in these two patents have significant limitations.

For example, the '006 patent teaches a method that creates a graded structure by using two layers that have different magnetic saturation numbers. Measuring magnetic saturation is a known technique in the industry as a non-destructive means to get a relative indicator of carbon level of the material. However, the carbon content variations, as measurable by magnetic saturation numbers, are rather small. Accordingly, the cobalt content gradient created by the method of '006 patent is also rather small—i.e., often in the 1-2% range. In turn, because the cobalt gradient is small, the gradient of mechanical properties in the resulting material will also be small. The fact that only a small gradient of desired mechanical properties is possible under the '006 patent means that this method for preparing functionally graded tungsten carbide materials is inflexible and will likely have few commercial applications.

Likewise, the '460 patent teaches a completely different processing method whereby a graded structure is created through a carburizing treatment-i.e., through a post-sintering heat treatment in a carbon rich atmosphere. However, this extra heat treatment step is expensive and very inefficient. Moreover, this method of production has severe limitations with respect to the depth of the graded zone in a component and the range of graded compositions. In fact, the '460 patent specifies the depth of graded layer to be less than 500 microns, which may not be acceptable for many commercial applications.

Accordingly, while the '006 patent and the '460 patent provide some methods for producing functionally graded materials, these methods are severely limited. A new type of method is needed that is cost effective, more flexible, and will create a wider range of graded microstructures and/or a wider range of properties. Such a new method is disclosed herein.

BRIEF SUMMARY OF THE INVENTION

The present invention relates to functionally graded composite materials, and methods of making the same. The functionally graded material will generally be made of two phases, a hard phase and a matrix metal phase. The hard phase is generally embedded in the matrix metal phase. A typical example of a hard phase is tungsten carbide. However, other types of materials may also be used as the hard phase including titanium carbide, tantalum carbide, titanium nitride, TiCN, double cemented carbides, cellular structured WC—Co/Co composition materials, other hard ceramic materials, etc.

The functionally graded material will have a continuous gradient of the matrix metal Phase—i.e., the amount of the matrix metal in the composite is graded from one reference point to another reference point within the material. It is this gradient of the matrix metal that gives the composite material is functionally graded properties. A typical example of a matrix metal that is commonly used is cobalt. Other materials may also be used as the matrix metal including, but not limited to, iron, nickel, other transition metals, alloys of transition metals, mixtures of Co and transition metals or metal alloys, transition metal alloys that contain alloying elements selected from carbon, boron, tungsten, molybdenum, chromium, vanadium, and/or tantalum.

The functionally graded materials may be formed in the following manner. First, a sample of the composite materials is obtained. Again, the composite comprises a hard phase and a metal matrix phase, wherein the hard phase comprises at least two chemical elements (such as, for example, tungsten and carbon). The sample of the composite will also have a first layer and a second layer. Both the first and second layer will each contain a quantity of matrix metal (such as cobalt metal).

In the present materials, one of the layers is deficient in an element of the hard phase and one of the layers is enriched with said element of the hard phase. Accordingly, when the sample is sintered, the heated conditions cause atoms of said element to diffuse in a direction from the enriched layer to the deficient layer and cause atoms of the matrix metal to flow in the same direction as the diffusion, thereby creating a gradient of the matrix metal in the sample.

An example of a material within the scope of the present invention is a WC—Co material. This material may be made as follows. First, a sample of WC—Co is obtained. Again, this sample will have a first layer and a second layer which each have a quantity of cobalt. In most materials, the first and second layers each contain a substantially stoichiometric amount of carbon.

After this sample has been obtained, one of the layers is converted into a carbon-deficient layer and the other layer is converted into a carbon-enriched layer. Such conversion is generally accomplished by added excess tungsten to form the carbon-deficient layer and adding excess carbon to the other layer to form the carbon-enriched layer. Generally, the number of moles of tungsten that is added to the carbon-deficient layer will be substantially equal to the number of moles of carbon that is added to the carbon-enriched layer. As a result, when the material is sintered (in the manner discussed below), the end-product will not be either carbon-enriched or carbon-deficient.

Once the carbon-enriched layer and the carbon-deficient layer have been formed, the entire sample will be sintered using liquid phase sintering methods. Such sintering of the sample causes carbon atoms to diffuse from the carbon-enriched layer to the carbon-deficient layer. In turn, such diffusion of the carbon atoms causes liquid cobalt to flow in the same direction as the carbon diffusion, thereby creating a gradient of cobalt in the sample. Thus, when the sintering is finished, a cobalt gradient exists in the sample.

The nomenclature for the materials described herein will be as follows. The term "[WC-X% Co]" refers to a tungsten carbide material that contains a designated amount (i.e., "X" percent) of Co. Thus, for example, the term [WC-6% Co] would refer to a tungsten carbide material with 6% Co. If there is no additional terms are given in the nomenclature, then the material will have a stoichiometric amount of carbon. However if an additional term is given in parenthesis ("Y% C"), then this percentage will refer to the total carbon content. Thus, for example, the term "[WC-6% Co](6.3% C)" would refer to a tungsten carbide material with 6% Co in which the total carbon content for the material was 6.3%. Likewise, for example, the term "[WC-16% Co](7.3% C)" would refer to a tungsten carbide material with 16% Co in which the total carbon content for the material was 7.3%, etc.

DETAILED DESCRIPTION OF THE INVENTION

Figure 1:
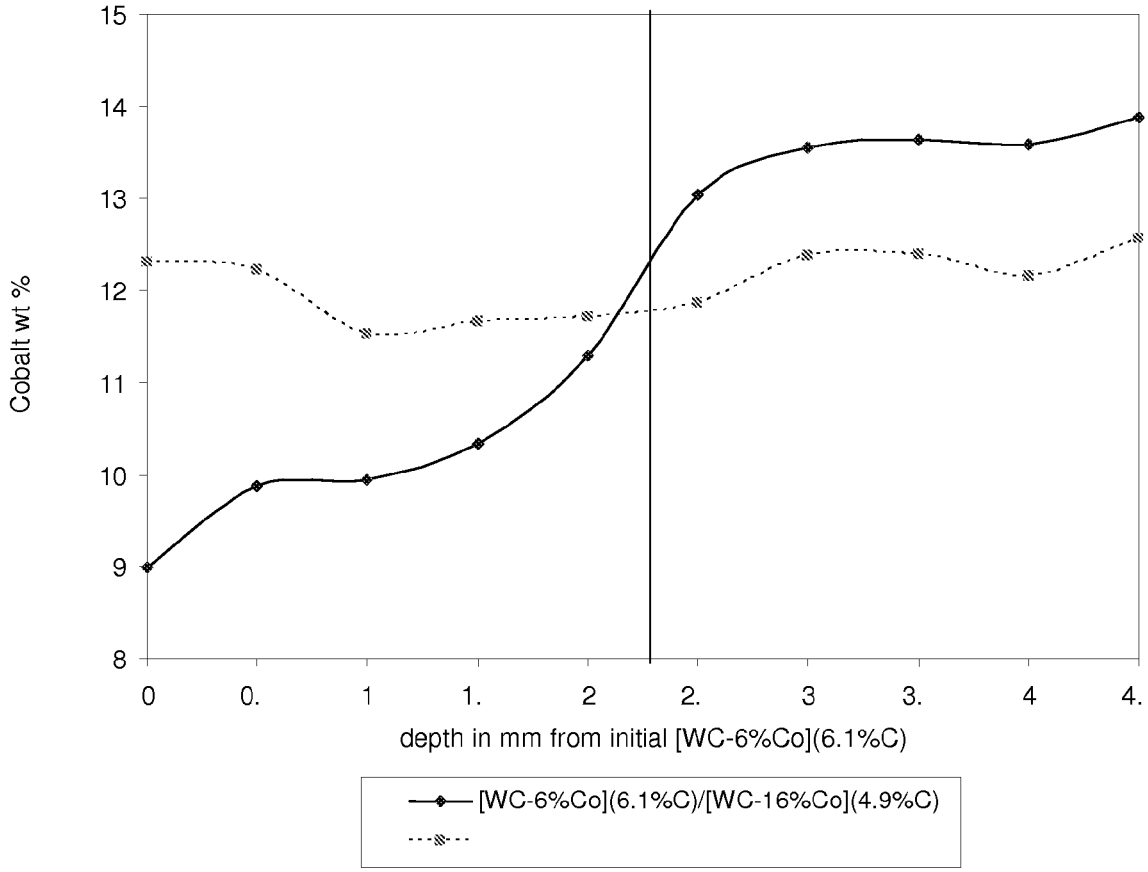
FIG. 1 is a graph of the spatial distribution of cobalt in [WC-6% Co]/[WC-16% Co] and [WC -6% Co](6.1% C)/[WC-16% Co] (4.9% C) bilayers WC—Co cermets.

Presently preferred embodiments of the invention will be described by reference to the drawings. It will be readily understood that the features of the present invention, as generally described and illustrated in the figures herein, may be varied. Thus, the following more detailed description of the embodiments of the present invention, as represented in FIGS. 1 through 15, is not intended to limit the scope of the invention, as claimed, but is merely representative of certain preferred embodiments of the invention.

The present invention relates to a new type of functionally graded composite materials. These materials are formed via liquid process sintering. In general, these materials include a supply of a hard phase. An example of a hard phase is tungsten carbide.

The hard phase is embedded within a metal matrix such that there is a gradient in the amount of metal matrix. More specifically, the amount of matrix metal in the composite is graded from a first reference point up to a second reference point within a graded zone. In some embodiments, the first reference point is an outer surface of the material and the second reference point is a point on the interior of the material. The metal matrix may include, but is not limited to, cobalt, iron, nickel, other transition metals, etc.

One type of a functionally graded composite material is illustrated by the following example which uses tungsten carbide as the hard phase and cobalt as the metal matrix. A component or part is fabricated of a WC—Co material which has about 6 percent (by weight) of cobalt on its surface, but the cobalt content increases gradually as a function of the depth from the surface to the interior of the component. (Again, unless otherwise specified, all percentages are given as weight percents). The cobalt content of the component increases until about 16% by weight and then it levels off, which means that the bulk of the component has 16% Co. Other embodiments may be made in which the cobalt content on the surface of the component is about 9% and then gradually increases as a function of the depth from the surface to the interior of the component until it reaches about 14%. Of course, other embodiments may be made in which the amount of cobalt is the greatest on the outer surface of the component and then is graded so that it gradually decreases as a function of the depth of the component.

The functionally graded materials of the present invention may comprise a variety of different cobalt gradients. For example, some embodiments may be made in which the amount of cobalt is graded from about 0.1% to about 30% by weight. Other embodiments may be made in which the gradient of Co found in the material ranges from about 6% to about 20%. Additional embodiments may be made in which the gradient of Co found in the material ranges from about 3% to about 20%. Still further embodiments may be made in which the gradient of Co found in the material ranges from about 6% to about 16%. In fact, any type or amount of Co gradient may be made, provided that Co concentration within the gradient falls somewhere between about 3% (on the low end) and about 30% (on the high end). Further embodiments may be made in which the range of Co within the gradient falls somewhere between about 0.1% (on the low end) and about 30% (on the high end).

The present invention also relates to a method for making these functionally graded materials via liquid phase sintering processes. This method will be described in relation to a WC—Co material. First, a sample of WC—Co powder material is obtained. This sample generally includes (at least) a first layer of material and a second layer of material. In some embodiments, the first and second layer will each have a substantially stoichiometric amount of carbon. (A stoichiometric amount of carbon in WC materials is about 6.13% by weight). The first and second layers of material also include a quantity of Co. In fact, the first and second layers are generally made of WC—Co. However, the amounts of the Co in the WC—Co found in the first and second layers may be different. For example, in some embodiments, the amount of Co in the first layer may be greater than the amount of Co in the second layer. However, other embodiments may also be made in which the amount of Co in the second layer is greater than that amount of Co in the first layer.

One of the layers is converted into a carbon enriched layer and the other is converted into a carbon-deficient layer. The terms carbon enriched and carbon deficient are in comparison to the stoichiometric carbon content of tungsten carbide WC which is about 6.13% carbon by weight. As will be discussed in greater detail below, the purpose of such conversions is to ultimately create a carbon gradient within the part prior to sintering. In order to form this carbon-enriched layer and this carbon-deficient layer, usually excess carbon powder and excess tungsten is used respectively. Specifically, the carbon-deficient layer is formed by adding excess tungsten powder to the layer. The addition of excess tungsten means that the layer is carbon-deficient. Likewise, the carbon-enriched layer is formed by adding excess carbon (either in the form of carbon black or graphite) to the layer.

Other embodiments may be made in which the carbon-enriched layer and the carbon-deficient layer are formed from starting materials in one easy step. This step involves mixing the appropriate amounts of carbon, tungsten, cobalt, and/or tungsten carbide together to form a sample of a tungsten carbide material that contains the first layer and the second layer, wherein one of the layers is a carbon-deficient layer and the other layer is a carbon-enriched layer.

It should be noted that the amount of tungsten that is used to form the carbon-deficient layer directly relates to the amount of carbon that is used to form the carbon-enriched layer. More particularly, the molar amount of tungsten added to the carbon-deficient layer should be equal to the molar amount of carbon added to the carbon-enriched layer. Accordingly, when the product is sintered (as will be discussed below) the excess carbon atoms in the carbon-enriched layer diffuse, react, and combine with the excess tungsten atoms in the carbon-deficient layer to form new grain WC. Because the number of excess carbon atoms substantially equals the number of excess tungsten atoms, the resulting tungsten carbide product is neither carbon-deficient nor carbon-enriched. Rather, the resulting product has the proper stoichiometric amount of carbon and tungsten.

Once the carbon-enriched layer and the carbon-deficient layer are obtained, and the layers are assembled together by a pressing or forming method, the sample may be sintered. In some embodiments, such sintering uses known liquid process sintering techniques, such as heating the sample at 1400° C. for 1 hour. In other embodiments, the sample is sintered using a temperature (or temperatures) between 1320° C. and 1500° C. Of course other sintering methods and/or process may also be used.

As will be explained in greater detail below, sintering the sample allows the atoms to diffuse from the carbon-enriched layer to the carbon-deficient layer and create a gradient of cobalt in the sample. In some embodiments, the cobalt will be graded continuously from one reference point to another reference point within the material.

It should also be noted that the depth of the graded zone of the Co within the material will depend upon the particular embodiment. For example, embodiments may be constructed in which the gradient (or graded zone) of the Co within the material will extend from the surface of the material to a depth of between about 10 microns to about 500 microns. In other embodiments, the graded zone in the material will extend from the surface to a depth of between about 10 microns to about 5000 microns. Still further embodiments may be made in which the graded zone in the material will extend from the surface to a depth that is greater than 500 microns.

As noted above, the WC—Co materials have different cobalt content within the graded zone. For example, WC—Co materials may be constructed in which the cobalt gradient varies by more than 2 percent (by weight) within the graded zone. In other WC—Co materials, the cobalt gradient may vary by more than 6 percent (by weight) within the graded zone. Still further WC—Co materials, the cobalt gradient may vary by more than 10 percent (by weight) within the graded zone.

An example of the sintering process is given. To make a cylindrical circular disc with continuous cobalt gradient from its top surface to the bottom surface, the top half of the disc can be made with powder that has excess carbon content relative to stoichiometric compositions, and the lower half of the disc can be made with powder blend that is carbon deficient relative to stoichiometric compositions. During liquid phase sintering, the carbon diffuses from carbon rich half to the carbon deficient half until the carbon content is equalized across the entire part.

It is noted that in performing this method, the carbon content of the deficient portion must be low enough such that the part contains η phase when sintered separately. η phase is a complex carbide compound of W and Co. Its typical chemical formula is $W_xCo_yC_z$, where x is about 3, y is about 3, and z is about 1.

When carbon atoms diffuse from the excess carbon portion to the part that contains η phase particles, carbon atoms react with η phase and produce WC and Co. It is discovered that during the process of carbon diffusion, there is also a migration of liquid cobalt phase in the direction of carbon diffusion. The migration of cobalt phase leads to a continuous gradient of cobalt content along the directions of carbon diffusion.

Without being bound by theory, it is believed that when the carbon reacts with η phase, it releases cobalt metal and raises the Co content (volume fraction of cobalt) near the reaction interface. Because the volume fraction of liquid Co phase in the part that contains η phase is lower than that of the portion containing excess carbon (assuming the total weight fraction of cobalt is the same for both parts), the excess volume of liquid Co near the reaction interface flows toward the portion that contains η phase. This reaction and migration process repeats/cycles as the reaction interface moves away from the carbon rich portion toward the carbon deficient portion.

One method for preparing the first and second layers, as well as the carbon-deficient layer and the carbon-enriched layer, will now be explained. The first and second layers of WC—Co are obtained, usually through preparation or purchase. As noted above, the first and second layers, likely do not have the same amounts of Co, although they may have the same the amount of cobalt. Excess amounts of tungsten powder and carbon are then added to the specific layers, thereby converting one layer into a carbon-enriched layer and the other layer into a carbon-deficient layer. Once the carbon-enriched layer and the carbon-deficient layer have been formed, a wet milling process occurs. This may occur by placing these powder materials in heptane and plastic jars filled with carbide balls to 60% volume for 16 hours on a rolling mill. Such rolling on the mill operates to crush and mix the powders. Once the sample has been milled, the material may then be pressed or formed into a green compact. (The term "green compact" means any pressed or formed shape that is made from the powder materials.) This green compact generally takes the shape of the desired article or resulting product. Then, the product is sintered in the manner described above and the gradient of Co is formed within the product.

The following table and figures show the results of various samples and materials that have been made within the scope of the present invention. For example, Table 1 shows various examples of different WC—Co grades used and the amount of carbon and metallic tungsten powders added in each case:

TABLE 1

| Sample | layer | stochio-metric % Carbon | Carbon balance in alloy | % Co | Amount of powder added |
|---|---|---|---|---|---|
| A | 1st layer | 5.8 | 5.8 | 6 | |
| | 2nd layer | 5.2 | 5.2 | 16 | |
| B | 1st layer | 5.8 | 6.1 | 6 | 0.66 g of carbon |
| | 2nd layer | 5.2 | 4.9 | 16 | 12.25 g of tungsten |
| C | 1st layer | 5.8 | 6.3 | 6 | 1.06 g of carbon |
| | 2nd layer | 5.2 | 4.7 | 16 | 21.276 g of tungsten |
| D | 1st layer | 5.8 | 4.9 | 6 | 36.735 g of tungsten |
| | 2nd layer | 5.2 | 6.1 | 16 | 1.916 g of carbon |
| F | 1st layer | 5.8 | 4.7 | 6 | 46.809 g of tungsten |
| | 2nd layer | 5.2 | 6.3 | 16 | 2.348 g of carbon |
| G | 1st layer | 5.8 | 6.1 | 6 | 0.66 g of carbon |
| | 2nd layer | 5.5 | 5.2 | 10 | 11.569 g of tungsten |
| H | 1st layer | 5.8 | 6.3 | 6 | 1.06 g of carbon |
| | 2nd layer | 5.5 | 5 | 10 | 20 g of tungsten |
| I | 1st layer | 5.5 | 6 | 10 | 1.064 g of carbon |
| | 2nd layer | 5.5 | 5 | 10 | 20 g of tungsten |

FIG. 1 illustrates a spatial distribution of cobalt in a first layer [WC-6% Co] which started with 6% Co and the second layer [WC-16% Co] which started with 16% Co. As shown in FIG. 1, after the present method was performed, a Co gradient in the overall sample was formed. Specifically, the gradient was formed such that the resulting product had about 9% Co at the surface and slowly increased in amount until it reached about 14% Co. FIG. 1 also shows the percent Co in a sample that was not treated within the scope of the present method. Thus, as shown in FIG. 1, if the two bi-layers are not treated with the present method, the Co concentration in the two layers is substantially homogeneous following sintering, such that the entire product has about 12% Co.

Figure 2:
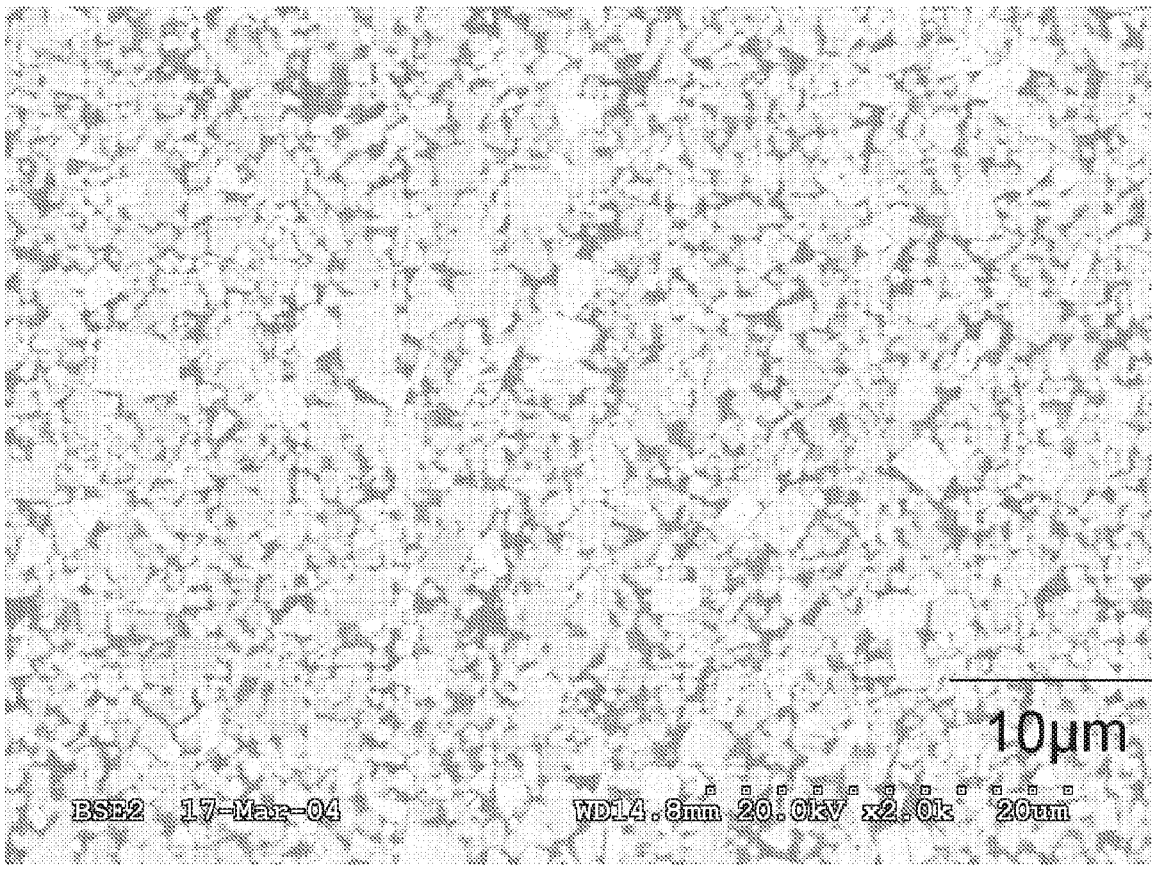
FIG. 2 is a SEM micrograph of [WC-6% Co](6.1% C)/[WC-16% Co](4.9% C) bilayers WC—Co cermet sintered at 1400° C.

FIG. 2 is a SEM micrograph of [WC-6% Co](6.1% C)/[WC-16% Co](4.9% C) bilayers WC—Co cermet sintered at 1400° C.

Figure 3A:
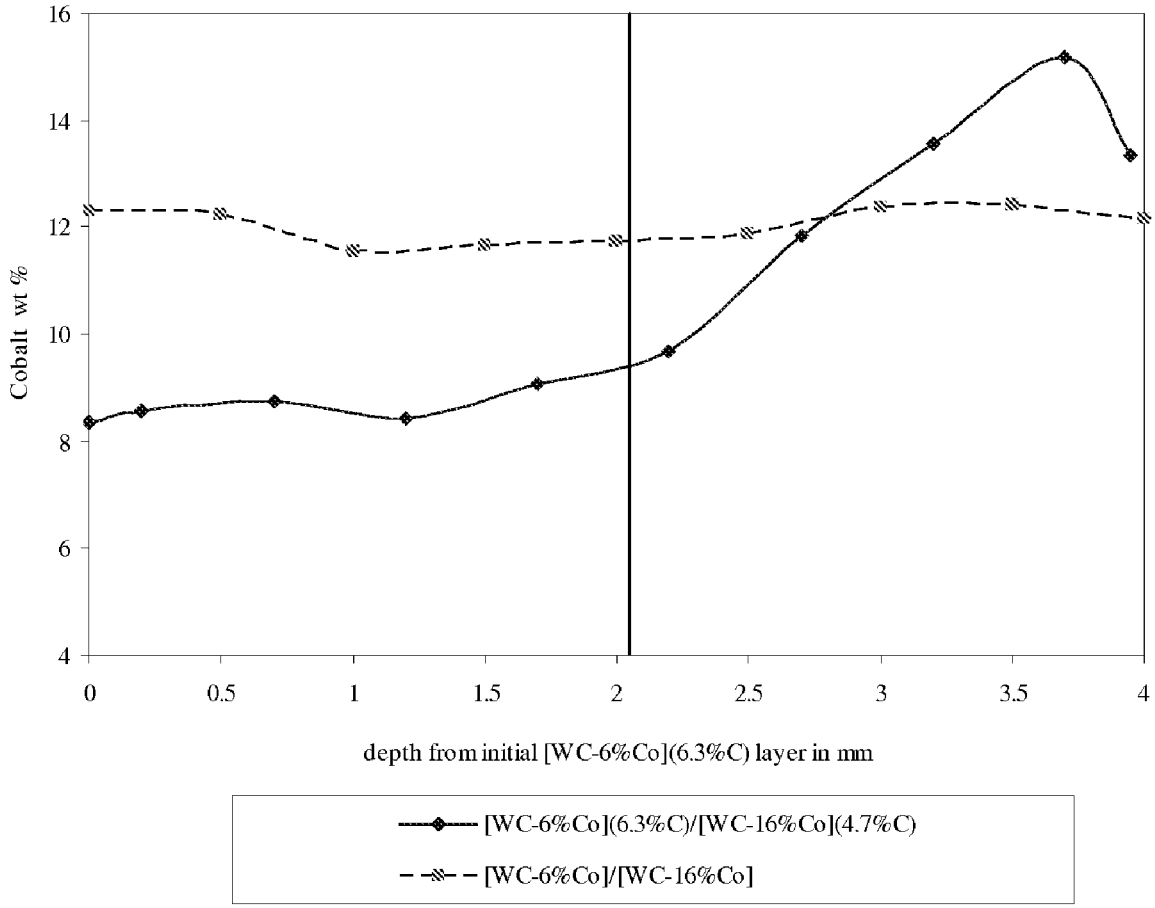
FIG. 3A shows a graph of the spatial distribution of cobalt in [WC-6%Co](6.3% C)/[WC-16% Co](4.7% C) bilayers with increased carbon gradient.

FIG. 3A shows the spatial distribution of cobalt in [WC-6% Co](6.3% C)/[WC-16%Co](4.7% C) bilayers with increased carbon gradient.

Figure 3B:
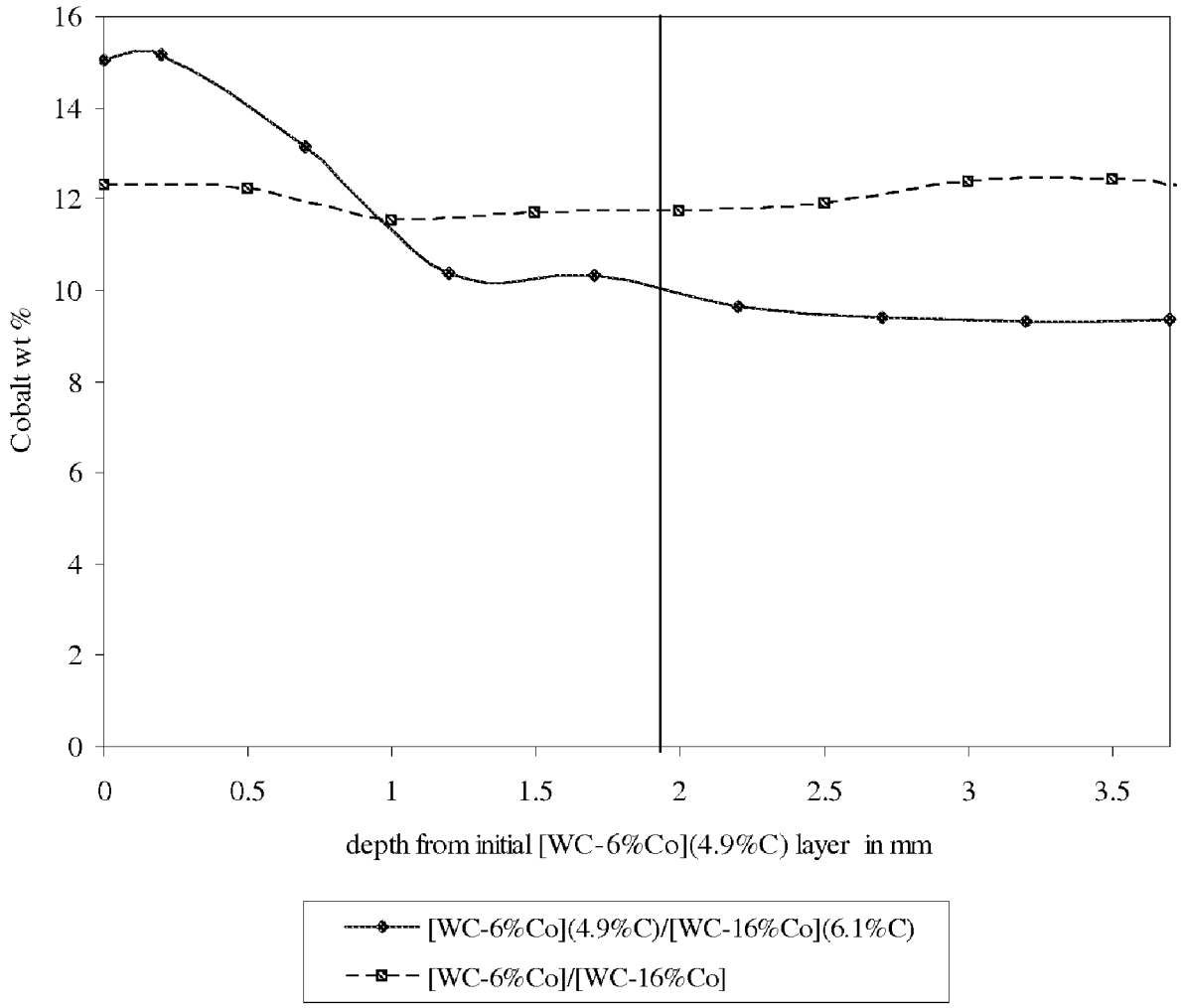
FIG. 3B shows a graph of the spatial distribution of cobalt in [WC-6% Co](4.9% C)/[WC-16% Co](6.1% C) bilayers with a reversed carbon gradient.
Figure 4:
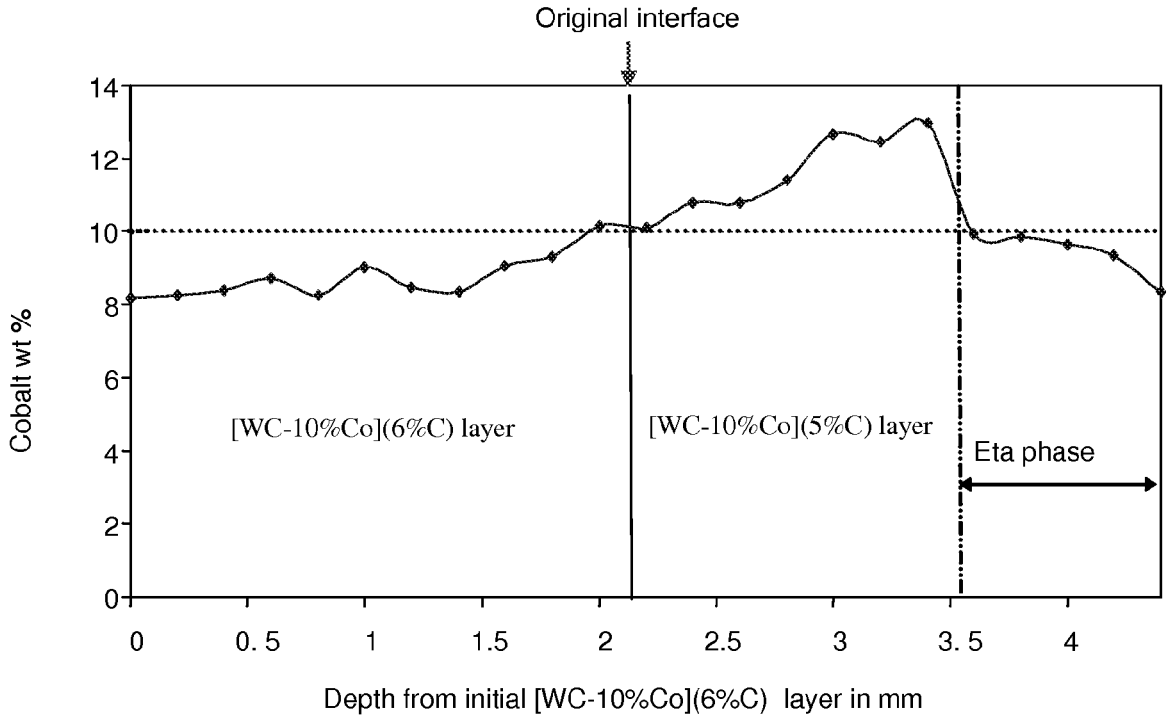
FIG. 4 shows a graph of the spatial distribution of cobalt in [WC-10% Co](6.1% C)/[WC-10% Co](5.1%C) sintered at 1400° C.

FIG. 3B shows the spatial distribution of cobalt in [WC-6% Co](4.9% C)/[WC-16%Co](6.1% C) bilayers with a reversed carbon gradient. In the two figures, there is comparison between bilayers with non stoichiometric carbon content and bilayers with stoichiometric carbon content;

FIG. 4 shows the spatial distribution of cobalt in [WC-10%Co](6.1%C)/[WC-10% Co](5.1% C) sintered at 1400 ° C. As can be seen in FIG. 4, this shows the η phase ("Eta phase") zone which exists in this product.

Figure 4A:
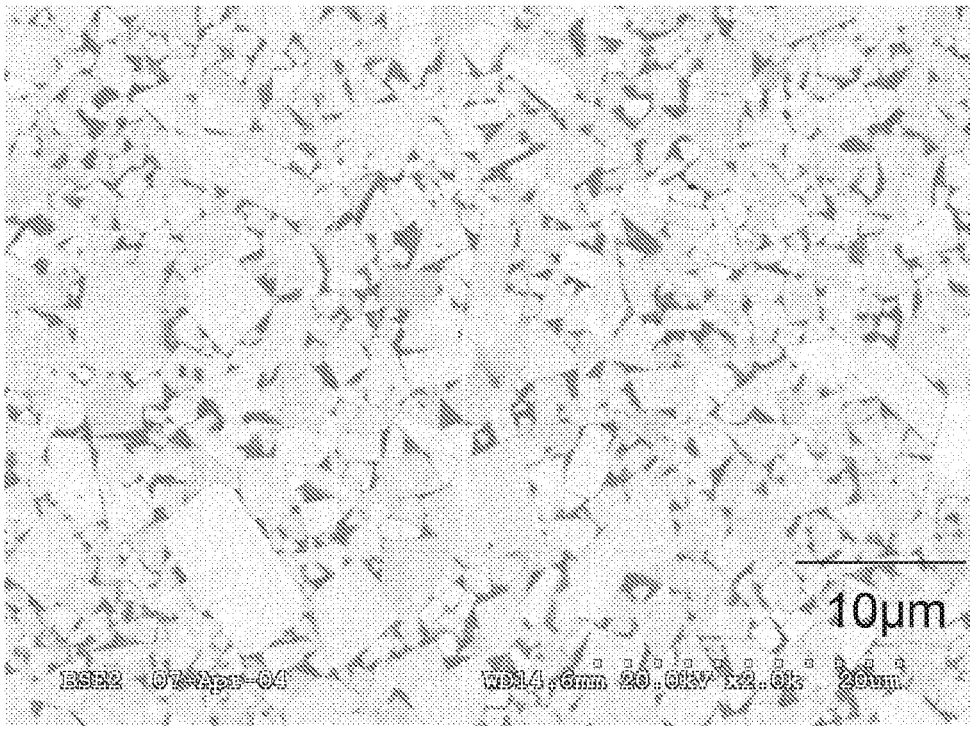
FIG. 4A is a SEM micrograph of a SEM micrograph of a [WC-10% Co](6.1% C) layer.
Figure 4B:
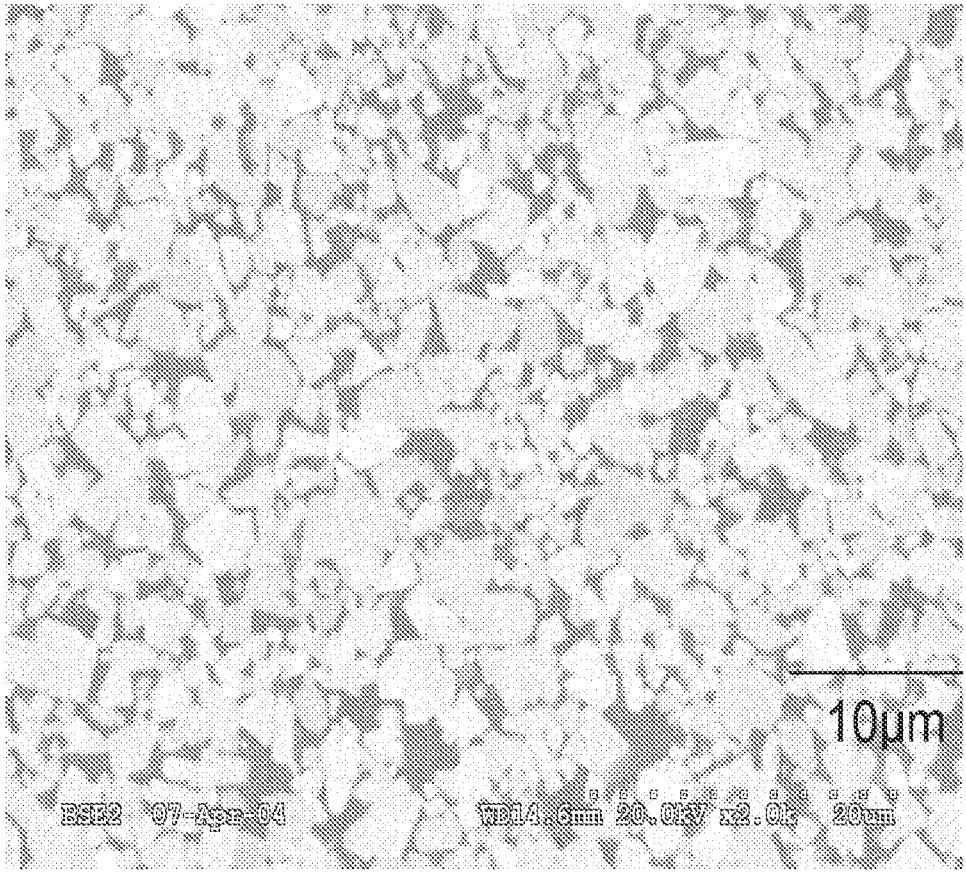
FIG. 4B is a SEM micrograph of a [WC-10% Co](5.1% C) layer.

FIGS. 4A and 4B are SEM micrographs of the each layer in [WC-10% Co](6.1% C)/[WC-10% Co](-5.1% C) bilayers with carbon gradient sintered at 1400° C. (A) SEM micrograph of [WC-10% Co](6.1% C) layer. (B) SEM micrograph of [WC-10% Co](5.1% C) layer.

Figure 5:
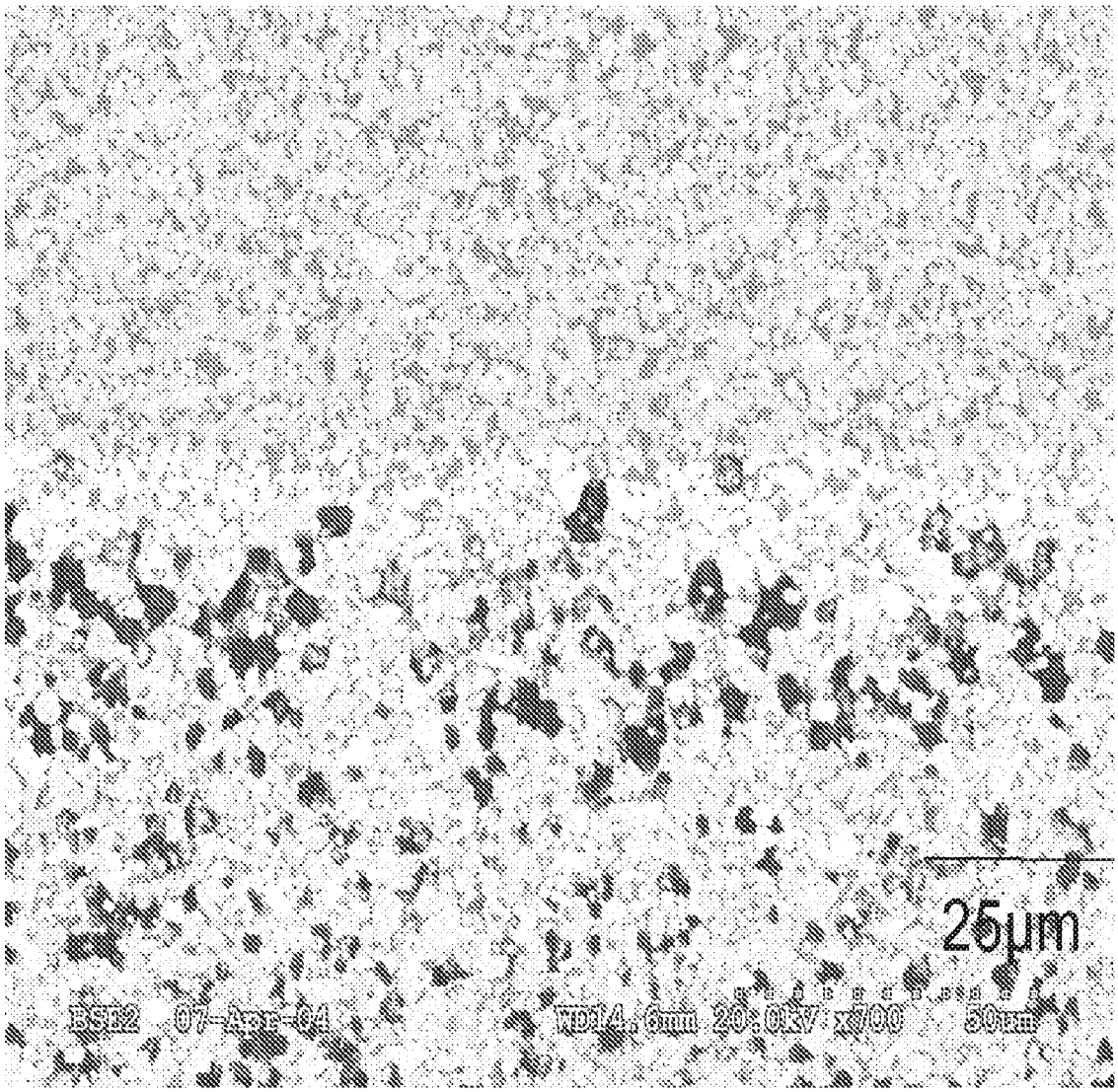
FIG. 5 is a SEM micrograph showing the interface between the (WC+β+η) phase region and the (WC+β) phase region in the [WC-10% Co](5.1% C) layer of the [WC-10% Co] (6.1 % C)/[WC-10% Co] (5.1% C) bilayers cermet.

FIG. 5 is a SEM micrograph showing the interface between the (WC+β+η) phase region and the (WC+β) phase region in the [WC-10% Co](5.1% C) layer of the [WC-10% Co] (6.1 % C)/[WC-10% Co] (5.1 % C) bilayers cermet.

It should also be noted that materials with different particle sizes, as well as different cobalt gradients, may also be prepared in accordance with the present embodiments. Many of these methods and materials are disclosed in a paper entitled "Liquid phase sintering of functionally graded WC—Co composites" by O. Eso, Z. Fang, an A. Griffo, which is an article currently in press and was accepted for publication in the International Journal of Refractory Metals & Hard Materials on 12 April 2005. This paper is expressly incorporated herein by reference.

Tables 2a-2d shows various samples that were prepared with different particle sizes. Specifically, Table 2a shows the composition of samples with different particle sizes but identical cobalt and carbon content in the two layers. Table 2b shows the composition of samples with different cobalt contents but identical particle size and carbon content in the two layers. Table 2c shows the composition of samples with different total carbon content in the two layers but identical particle size and cobalt contents. Table 2d shows the composition of samples with different cobalt and total carbon contents in the two layers but identical particle size.

TABLE 2a

Composition of bi-layers WC—Co with an initial difference in particle size

| Layer | Composition | Total carbon content |
|---|---|---|
| Layer 1 | WC—10%Co (1 μm) | stoichiometric |
| Layer 2 | WC—10%Co (5 μm) | stoichiometric |

TABLE 2b

Composition of bi-layers WC—Co with an initial difference in cobalt content

| Layers | Composition | Total carbon content |
|---|---|---|
| Layer 1 | WC—6%Co | stoichiometric |
| Layer 2 | WC—16%Co | stoichiometric |

TABLE 2c

Composition of bi-layers WC—Co with an initial difference in carbon content

| Layer | Composition | Total carbon content (weight %) |
|---|---|---|
| Layer 1 | WC—10%Co | 6.0 |
| Layer 2 | WC—10%Co | 5.0 |

TABLE 2d

Composition of bi-layer WC—Co with an initial difference in cobalt and carbon

| Layers | Composition | Total carbon content (weight %) |
|---|---|---|
| Layer 1 | WC—6%Co | 6.1 |
| Layer 2 | WC—16%Co | 4.7 |

The samples shown in Tables 2a-2d were prepared as follows. All the raw materials of graded WC—Co powders had stoichiometric carbon content. Hereafter, the term "total carbon content" will refer to the WC—Co composite, to distinguish it from carbon content of WC only. In order to create a carbon gradient in a powder prior to sintering, tungsten powders were added to WC—Co powders to reduce the total carbon content below the stoichiometric value while pure graphite powders were added to the WC—Co powders to increase the total carbon content above the stoichiometric value in the alloy. The powder mixtures were ball milled using a rolling mill for 16 hours in heptane. After milling, the powders were dried in a rotavapor under vacuum. The dried WC—Co powders were cold pressed at 200 MPa. in a rigid die into laminate disks (19.4 mm dia.×4 mm thick) consisting of two layers. Each layer has a different predetermined composition.

The samples were sintered in a vacuum furnace at 1400° C. for 60 min. The sintered bi-layer samples were ground and polished to 1 μm finish for microstructural examinations. The cobalt distribution in the WC—Co bi-layers was measured using the Energy Dispersive Spectroscopy (EDS) on the SEM. Each data point on the cobalt distribution profile was generated by averaging EDS scans over an area of 0.1 mm by 12 mm.

Figure 6:
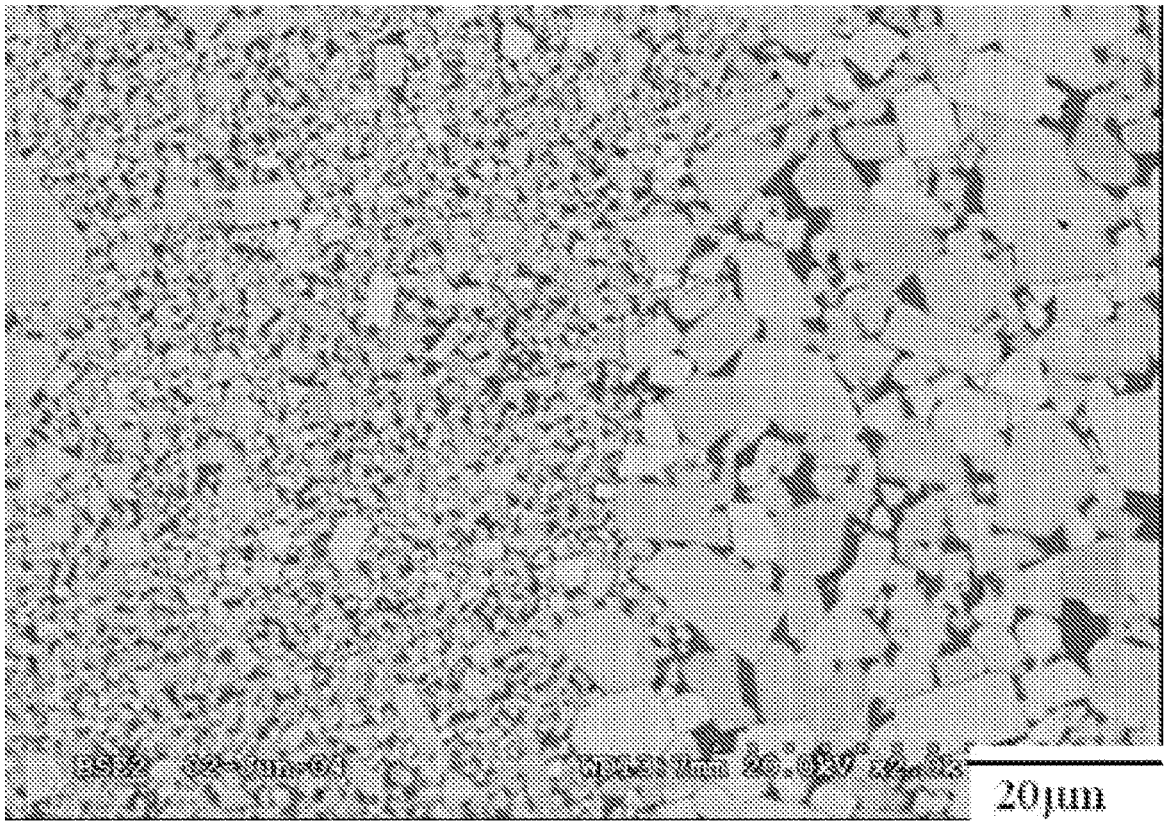
FIG. 6 is a SEM micrograph of WC-10% Co bi-layer with difference in grain size sintered at 1400° C. for 1 hour.
Figure 7:
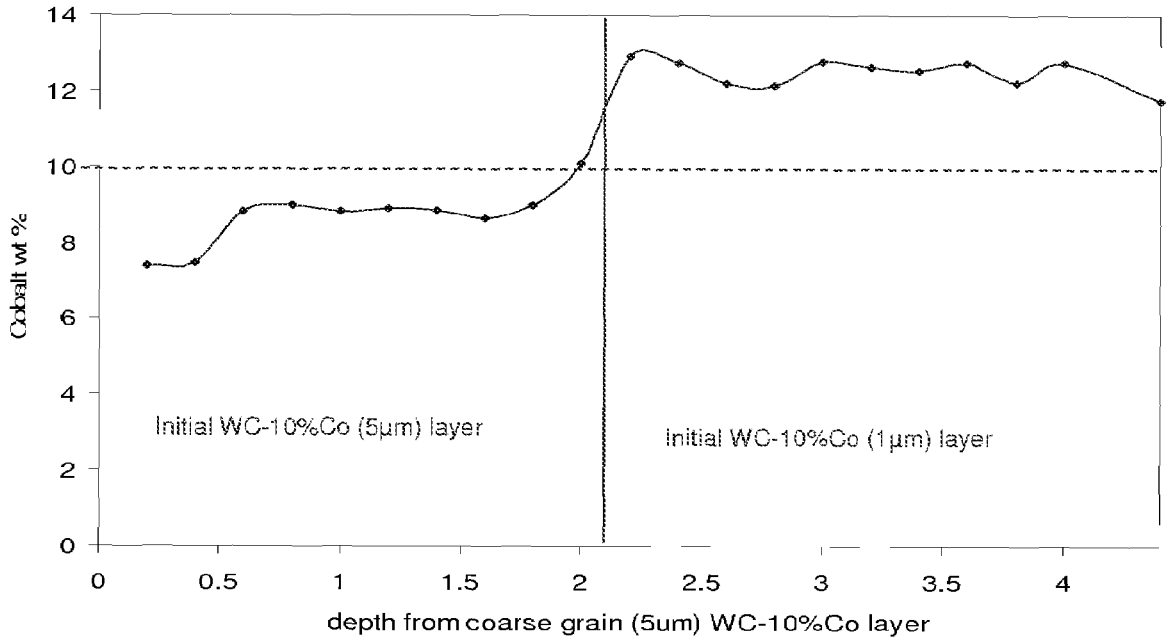
FIG. 7 is a graph of the distribution of cobalt in a WC-10% Co bi-layer specimen with difference in grain size sintered at 1400° C. for 1 hour.

The significance and import of the samples shown in Tables 2a-2d will now be discussed in greater detail in conjunction with FIGS. 6 through 12. Specifically, FIG. 6 shows the SEM micrograph of a bi-layer WC—Co specimen listed in Table 2a and sintered at 1400° C. The bi-layer specimen had a nominal cobalt content of 10% by weight in both layers. Each layer had WC grain size of 1 μm and 5 μm respectively. FIG. 7 shows the cobalt distribution profile of the bi-layer WC—Co specimen in FIG. 6 measured using EDS. A stepwise profile of cobalt concentration is observed between the two layers after sintering due to the difference of particle sizes. The cobalt content in the layer with 5 μm WC grain size decreased to approximately 8% by weight while the layer with 1 μm WC grain size increased to approximately 12% by weight.

Figure 8:
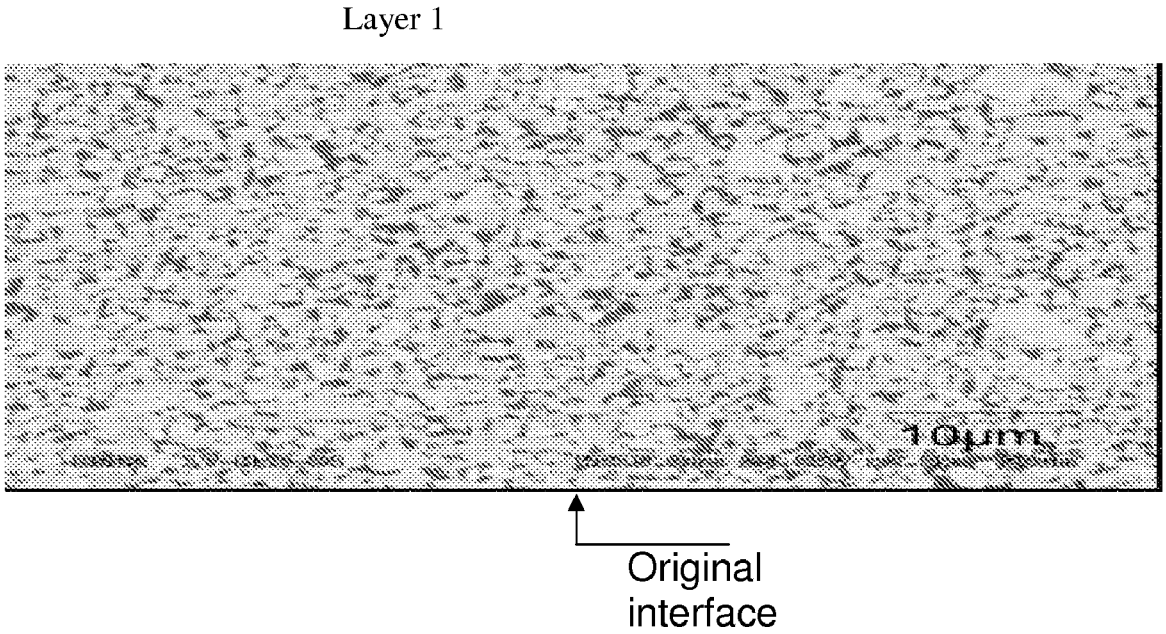
FIG. 8 is a SEM micrograph of WC—Co bi-layer with identical grain sizes and stoichiometric carbon content but different initial cobalt contents in the layers sintered at 1400° C. for 1 hour.

FIG. 8 shows a micrograph of WC—Co bi-layer from Table 2b sintered at 1400° C. The total carbon content in both layers is stoichiometric. The initial cobalt content in one layer was 6% by weight while the other layer had 16% by weight. After liquid phase sintering, as expected, the cobalt content has completely homogenized across the two layers after sintering at 1400° C. for 1 hour. The homogenized cobalt content of the sintered part was approximately 12% by weight.

Figure 9:
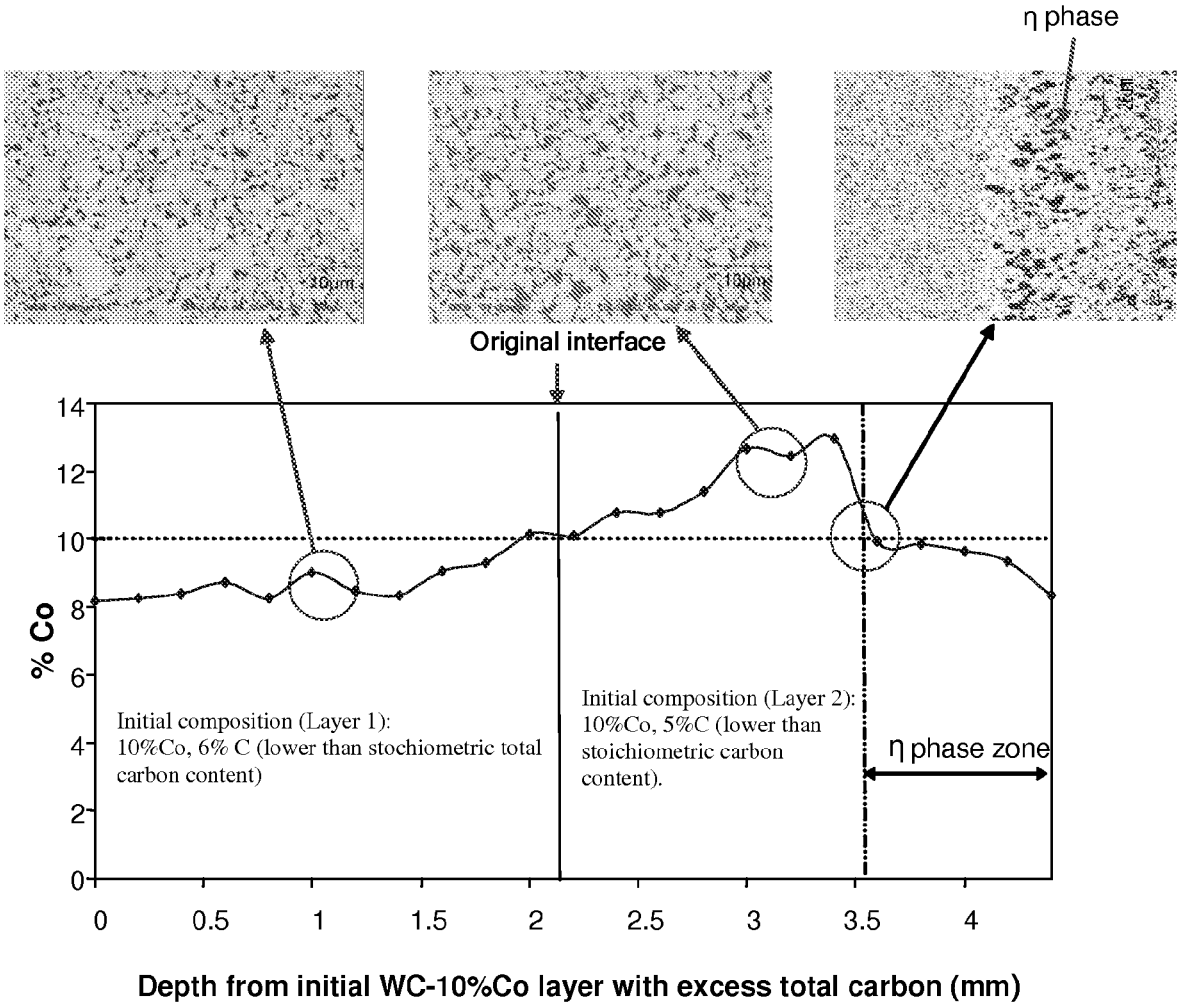
FIG. 9 shows the cobalt distribution in a WC—Co bi-layer specimen with identical initial cobalt content and grain sizes but different initial total carbon content sintered at 1400° C. for 1 hour.

FIG. 9 shows the cobalt distribution in a bi-layer WC—Co specimen from Table 2c sintered at 1400° C. Both layers had an initial cobalt content of 10% by weight. The total carbon content in one layer was reduced significantly below the stoichiometric value to 5.0% by weight while the total carbon content in the other layer was increased above the stoichiometric value to 6.0% by weight such that η phase and free carbon would form in the layers respectively at the sintering temperature if they were sintered separately. As shown in seen from FIG. 9, a gradient of cobalt was created after sintering the two layers together as a bi-layer specimen. The cobalt content varied gradually from 8% in the layer initially with excess total carbon content to about 13% in the layer initially with a deficiency in total carbon content. The micrographs in FIG. 9 show the different microstructure zones formed in the sample after sintering. A η phase zone can be observed towards the edge of the layer which was carbon deficient. This shows that there was only partial homogenization of carbon across the structure. In this η phase zone, there is a sudden decrease in cobalt content below the nominal value and just outside the η phase zone the highest cobalt peak of about 13% is observed.

Figure 10:
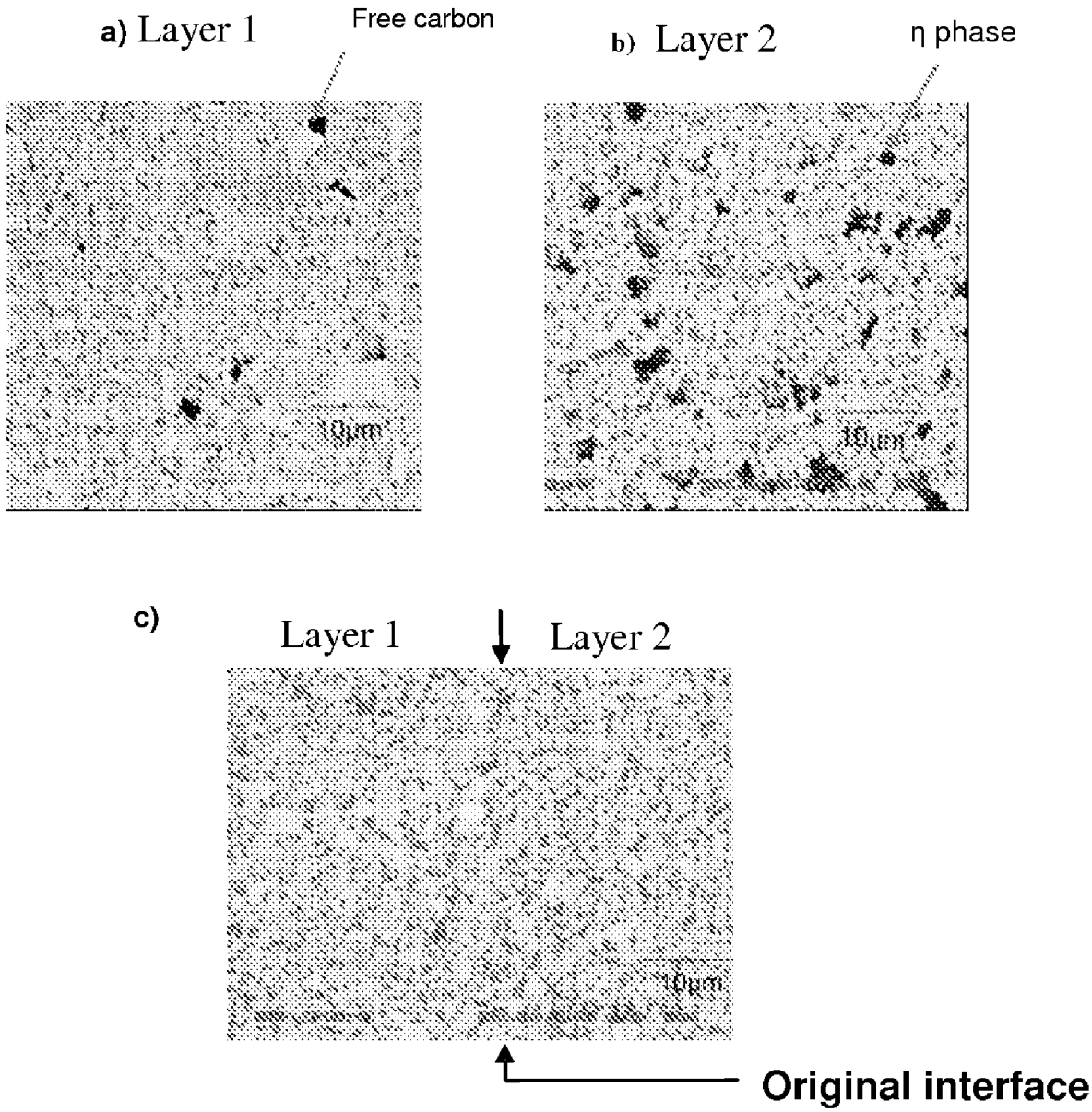
FIG. 10 is SEM Micrographs of (a) WC—Co with high total carbon content (b) WC—Co with low total carbon content and (c) WC—Co bi-layer with identical particle size but different initial total carbon content and cobalt content in the layers sintered at 1400° C. for 1 hour.

FIG. 10 shows micrographs of WC—Co specimen from Table 2d. In the green state, the total carbon content in the layer with relatively low cobalt content (6%) was increased to 6.1% by weight, which is significantly higher than the stoichiometric total carbon content of 5.76%. The total carbon content in the other layer with relatively high cobalt content (16%) was reduced to 4.7%, which is significantly lower than the stoichiometric total carbon content. FIGS. 10(*a*) and 10(*b*) show the microstructures of each layer sintered separately. The WC-6%Co layer with high carbon content shows free carbon while the WC-16%Co layer, with low carbon content, shows η phase in their microstructures respectively. FIG. 10(*c*) shows the microstructure of the bi-layer specimen (two layers pressed together) after liquid phase sintering. It shows no free-carbon nor η phase in the microstructure. This indicates that the excess carbon has reacted with the η phase. The carbon content has completely homogenized across the bi-layers and the final part has stoichiometric total carbon content. The cobalt content, however, was not homogenized across the two layers.

Figure 11:
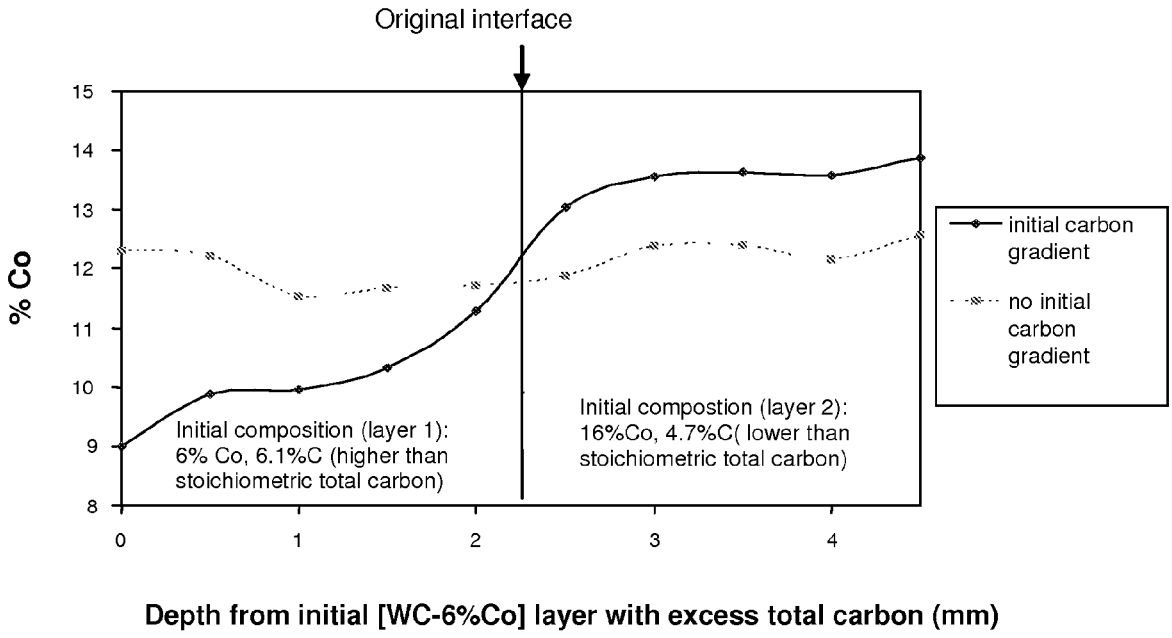
FIG. 11 is a comparative plot of the cobalt distribution of WC—Co with identical initial grain sizes but different initial total carbon and cobalt contents (solid line) and WC—Co with identical grain sizes and stoichiometric carbon contents but different initial cobalt contents (dotted line) sintered at 1400° C. for 1 hour.

FIG. 11 shows the EDS analysis of the cobalt concentration profile of the bi-layer WC—Co samples with identical particle sizes and an initial difference in cobalt and carbon contents. In the same figure, the cobalt concentration profile of bi-layer WC—Co specimen with identical particle sizes, an initial difference in cobalt contents and stoichiometric carbon contents in the layers is shown for the purpose of comparison. It is evident that the bi-layer WC—Co sample with an initial difference in carbon content shows a cobalt gradient after sintering at 1400° C. However, there is no cobalt gradient in the bi-layer sample initially with stoichiometric carbon content after sintering at 1400° C. It appears from the above results that cobalt migrates in the direction of carbon diffusion.

Figure 12:
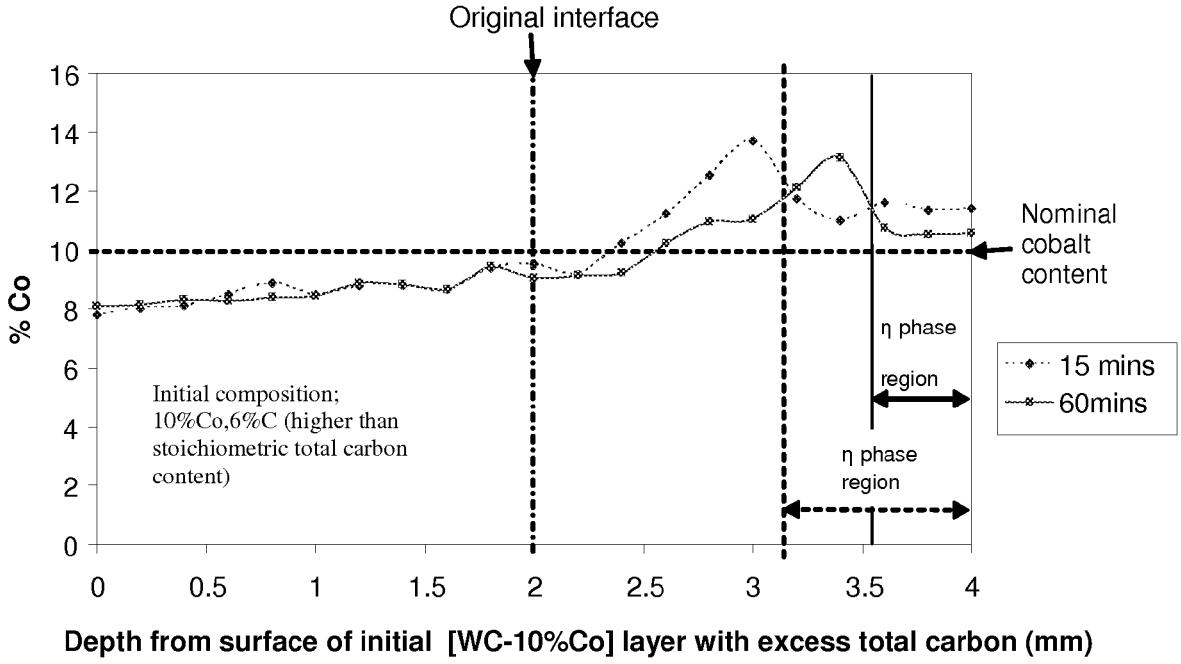
FIG. 12 is a graph of the effect of sintering time on the cobalt distribution of WC—Co bi-layer with identical initial cobalt contents and grain sizes but different initial total carbon content in the layers sintered at 1400° C.

FIG. 12 demonstrates the kinetics of the cobalt gradient formation process. As the sintering time is increased, the width of the WC+Co+η zone reduces. Sintering at 1400° C. for 30 minutes produces WC+Co+η zone width of approximately 0.8 mm. After sintering at 1400° C. for 60 minutes, the width of the zone reduces to about 0.4 mm. In addition, the cobalt distribution peak and the reaction interface move in the same direction towards the edge of the sample as the sintering time is increased. This demonstrates that as the sintering time is increased, carbon diffuses further into carbon deficient layer and reacts with η phase to produce WC—Co resulting in the migration of cobalt in the same direction.

The results presented above in conjunction with FIGS. 6 through 12 show that functionally graded WC—Co can be manufactured by controlling critical factors such as the initial particle size, initial carbon and/or cobalt content variations, and sintering time. The final cobalt distribution in the sintered sample is the result of the combined effects of these factors on the migration of liquid phase during sintering. The migration of liquid phase can be attributed to two underlying processes. First, the basic reason for liquid flow is the difference in volume fraction of the liquid phase between graded layers during sintering. The second reason is the local chemical composition inhomogeneity, which causes local variations in the volume fraction of liquid during sintering. These two aspects are discussed as follows.

First, without being bound by theory, it appears that a capillary force is the driving force for cobalt migration during sintering. Specifically, WC—Co, at liquid phase sintering temperature, consists of WC and liquid phase, which is primarily a cobalt solution with W and C as solutes. The liquid cobalt is uniformly distributed in between WC grains throughout the structure. The size of the cobalt pools is measured by mean free path (MFP) between WC grains. MFP is a function of cobalt content as well as grain size. When two WC—Co layers with different cobalt content are placed adjacent to each other, the flow of liquid between the two layers will be determined by the difference in capillary force between them. This problem can be modeled as an array of interconnected liquid channels between the tungsten carbide particles. The average size of these channels can be approximated by the MFP.

Figure 13A:
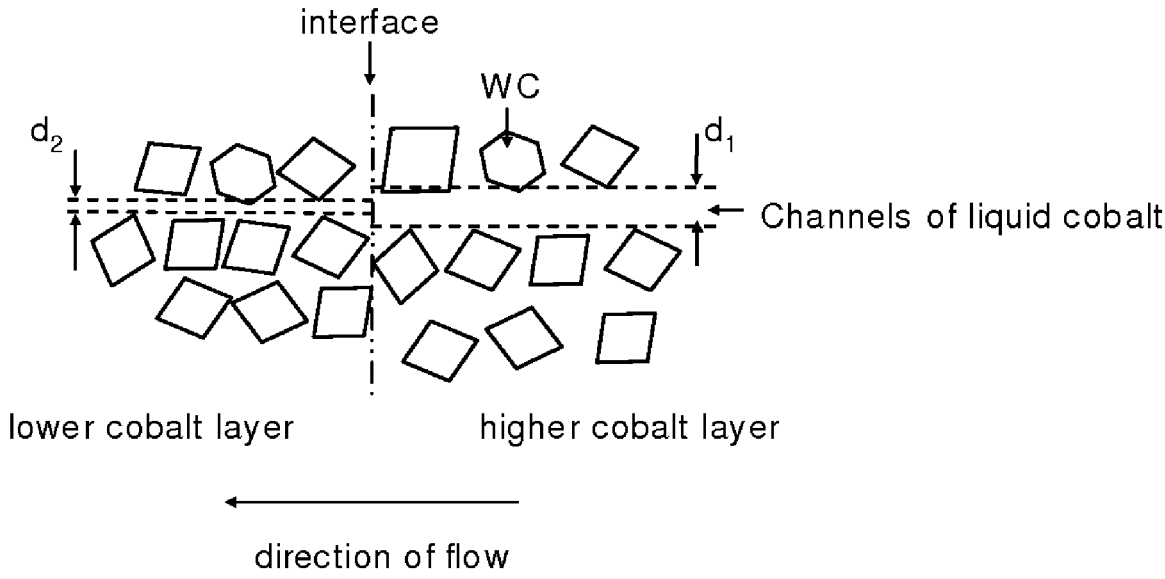
FIG. 13 is an illustrative diagram of (a) liquid channels formed during sintering of WC—Co bi-layer with identical grain size but different initial cobalt contents in the layers. (b) Cylindrical capillary tube with two different cross sections.
Figure 13B:
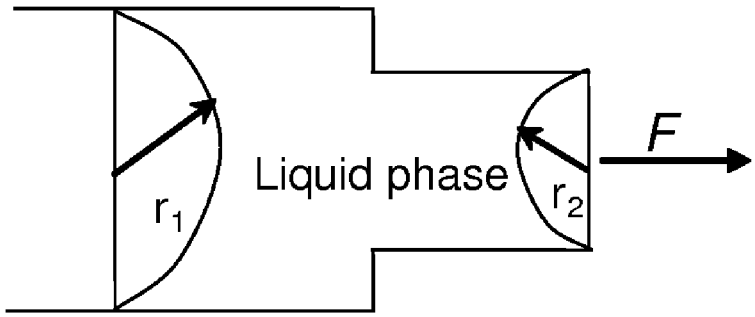

In the case of bi-layers with initial cobalt content differences but identical particle size and carbon content as shown in FIG. 9, at the liquid phase sintering temperature, the layer with higher cobalt content will have wider liquid channels in comparison with the layer with lower cobalt content. The structure of these liquid channels is illustrated in FIG. 13*a*. If the average sizes of the channels (MFP) in layers with higher and lower cobalt content are $d_1$ and $d_2$ respectively, then $d_1$ is greater than $d_2$. The liquid channels present in the two layers are analogous to a system of interconnected capillaries. Based on the principles of capillarity, a narrow capillary sucks out wetting liquid from a wider capillary due to the difference in capillary force. Thus, liquid will flow from the layer, initially with higher cobalt content, into the layer initially with lower cobalt content through the interconnected liquid channels by capillary force. This will cause the layer initially with lower cobalt content to swell due to the increase in liquid content and the layer initially with higher cobalt content will shrink due to the decrease in liquid content although the total liquid content in the sample is conserved. As the liquid phase flows, $d_1$ will decrease while $d_2$ will increase since the wetting liquid will not flow out of the sample. The in WC grain size will also produce a difference in the size of liquid channels formed during sintering. Finer grains form smaller liquid channels while coarser grains form larger liquid channels. Thus, liquid cobalt will flow into the layer with finer WC grain size by capillary force during sintering. This capillary force is expressed in the following equation and illustrated in FIG. 13B.

$$F = 2\pi\sigma\left(\frac{r_1^2}{r_2} - \frac{r_2^2}{r_1}\right)$$

where F is the difference in capillary force (N) acting on the small and large menisci. In FIG. 13*b*B, σ is the surface tension (N/m), $r_1$ and $r_2$ are the radii of curvature of the large and small menisci respectively.

Second, it is also important to note the effect of carbon on the volume fraction of liquid formed during sintering. During liquid phase sintering at 1400° C., which is significantly higher than the eutectic temperature, an equilibrium phase composition consists of WC and liquid cobalt phase. The volume fraction of the liquid phase can vary depending on the total carbon content in the alloy. Significant deviations below or above the stoichiometric carbon content will result in the occurrence of three phase equilibrium structure involving WC+Co+$W_3Co_3C$ (η) or WC+Co+C (graphite) respectively. The formation of $W_3Co_3C$ (η) phase in WC—Co during sintering ties up part of the cobalt phase, which leads to the reduction of the volume fraction of the liquid phase at the sintering temperature. The dependence of volume fraction of liquid on the carbon content can be modeled based on thermodynamic equilibrium calculations.

Figure 14:
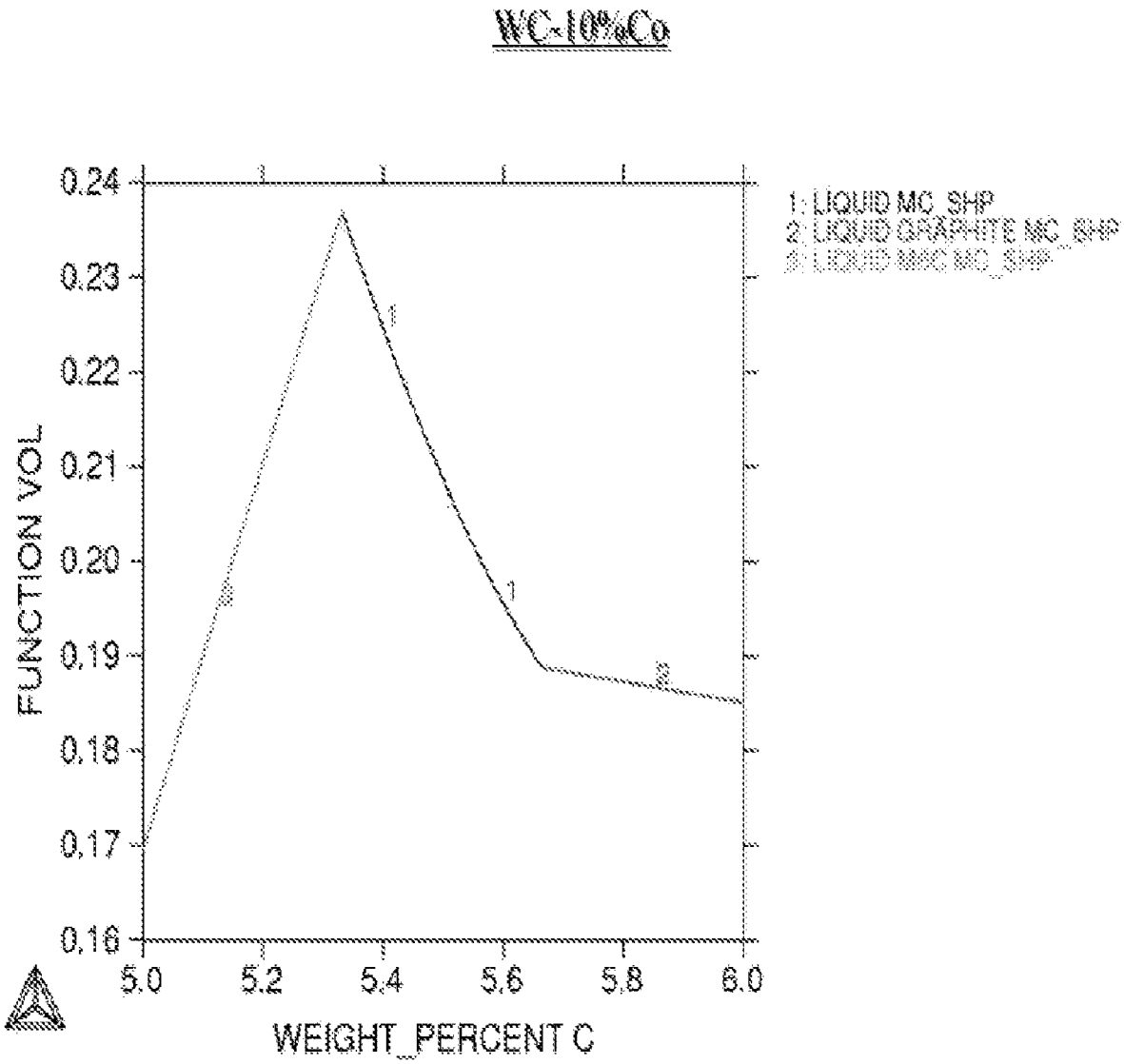
FIG. 14 is a calculated volume fraction of liquid as a function of total carbon content of WC-10% Co at 1400° C.

FIG. 14 is plot that shows the volume fraction of liquid phase as a function of the carbon content of a WC—Co alloy used for this study. The plot was generated using thermodynamic software (Thermo-Calc). The thermodynamic database for cemented carbides is available in literature. From FIG. 14, any local inhomogeneity in carbon content within a WC—Co system will result in a corresponding difference in volume fraction of liquid, which could lead to cobalt migration.

From the above-referenced results and the two underlying factors discussed above, there are three categories of possible scenarios which may form a cobalt gradient during sintering.

A. When There is No Initial Carbon Content Difference, but There are Initial Cobalt and/or Particle Size Differences.

When there is identical initial carbon content but a difference in initial cobalt content and/or particle size in the two graded WC—Co layers, cobalt migration is driven by capillary force only. When there is only a difference in particle size in the two layers as shown in FIG. 5, cobalt will migrate from the layer with coarser grain size to the layer with finer grain size due to capillary force. A difference in particle size will produce a step-wise profile of cobalt concentration. However, when the initial particle size is the same, but there is an initial difference in cobalt content between the two layers as shown in FIG. 9, cobalt will migrate from the layer with a higher cobalt content to the layer with a lower cobalt content due to the difference in capillary force.

B. When There is an Initial Carbon Content Difference, but There are No Initial Cobalt and/or Grain Size Differences.

In the case where the initial cobalt and particle size are identical but the initial carbon contents of the two layers are different as shown in FIG. 9, the cobalt gradient is determined by the equilibrium phase compositions as a function of carbon concentration profile. Carbon will diffuse to create a gradient of carbon from the carbon rich layer to the carbon deficient layer due to the difference in the chemical potential of carbon between the two layers. The carbon gradient and resulting carbon diffusion causes the liquid phase to flow in order to establish an equilibrium distribution of the volume fraction of the liquid phase in the sample. The shape of the distribution curve of the volume fraction of the liquid phase is similar to the shape of the plot in FIG. 14 as a function of the carbon profile. On the other hand, the diffusing carbon reacts with η phase to produce WC and liquid Co $$2C+W_3Co_3C \Rightarrow 3WC+3Co\ (L)$$

This reaction releases cobalt, which contributes to the volume fraction of the liquid phase near the reaction front.

Figure 15:
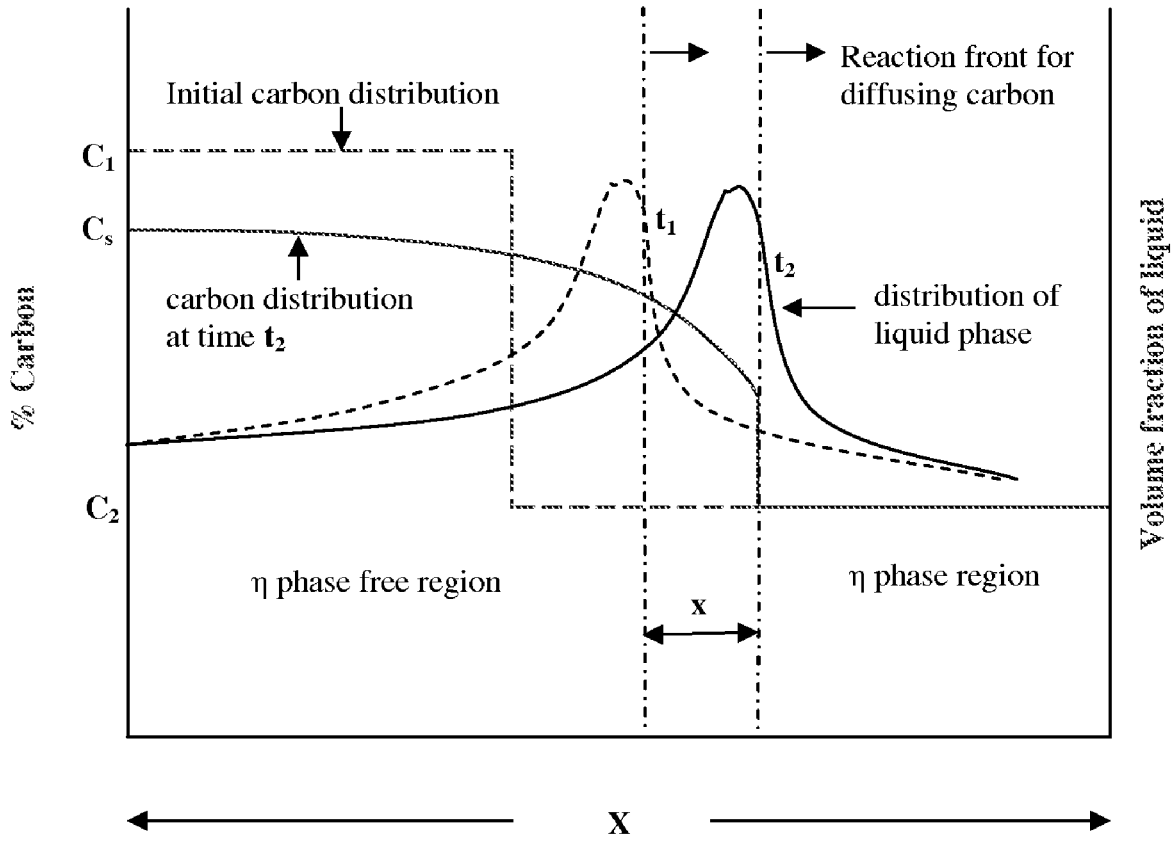
FIG. 15 is a schematic diagram showing the time dependence of cobalt gradient formation during liquid phase sintering of graded WC—Co.

This process is schematically illustrated in FIG. 15. $C_1$ and $C_2$ are the initial carbon contents of the carbon-rich layer and the carbon-deficient layer, respectively, and $C_s$ is the carbon content as a function of the position within the sample at time $t_2$. Between times $t_1$ and $t_2$, the reaction front has advanced a distance "x" within the sample. It implies that between the times $t_1$ and $t_2$, η phase in the area with length "x" in the sample has reacted with carbon and produced WC—Co as shown in FIG. 15. Carbon diffuses and the liquid phase migrates, both toward the η phase region, to establish the equilibrium profile of the volume fraction of liquid. The reaction front moves in the same direction and the cobalt distribution exhibits a similar shape during the process.

C. When There are Initial Carbon Gradients as Well as Initial Cobalt and/or Gain Size Gradient In the case when there is initial carbon content difference as well as initial cobalt and/or grain size differences, the final cobalt distribution is affected by all three factors. For example, when there is initially carbon and cobalt differences in WC—Co bi-layers as shown in FIG. 10, carbon diffusion and phase reactions counter the effect of capillary force due to the initial cobalt gradient (initial Δ% Co is 10% for the example in FIG. 10). The carbon deficient layer, which forms η phase at the sintering temperature, ties up a certain fraction of the cobalt in the system. The differences in volume fractions of liquid at the sintering temperature causes liquid to flow from the layer with a higher volume fraction of liquid to the layer with a lower volume fraction of liquid by capillary force. A difference in the chemical potential of carbon in the two layers causes carbon to diffuse from the layer where it is in excess to the layer where it is deficient. The diffusing carbon reacts with η phase, which yields WC and liquid Co. The overall shape of the distribution would be the sum of the effects of carbon diffusion and reactions with η phase and the effects of cobalt migration by capillary force as the results of difference in volume fraction of liquid due to the initial differences in cobalt and carbon contents between the two layers.

Thus, in summary, various factors, including grain size, carbon and cobalt contents, and sintering time, may affect cobalt migration during liquid phase sintering. Initial particle size differences can induce a step-wise profile of cobalt concentration while an initial difference in carbon content can be used to obtain a cobalt gradient within the sintered WC—Co specimen. The effects of these factors may be explained based on capillary force, equilibrium volume fraction of phases and phase reactions. All considered, the final cobalt distribution in the sintered functionally graded WC—Co sample may result from the combined effects of these factors on capillary force and phase equilibrium Although the foregoing discussion focuses on functionally graded materials that are made from WC—Co, it should also be noted that the present invention is not limited to this particular embodiment. Rather, other types of functionally graded materials that incorporate different elements and/or metals also fall within the scope of the present invention and may be formed in accordance with the principles disclosed herein. Thus, a more generalized formula for the functionalized graded materials HP-Mm wherein HP is the hard phase and Mm is the matrix metal. (In the above discussed embodiments, HP was the tungsten carbide and the Mm was the Co.) Specifically, other embodiments may be made in which the matrix metal (Mm) is a transition metal such as Ni, Fe, or their alloys. Other embodiments may be made in which the matrix metal (Mm) is a mixture or alloy of Co and one or more transition metals or metal alloys. Transition metal alloys may also contain other alloying elements such as carbon, boron, tungsten, molybdenum, chromium, vanadium, tantalum, and so forth. Likewise, further embodiments may also be made in which the HP does not wholly comprise tungsten carbide. For example, embodiments may also be made in which some or all of the tungsten carbide that forms the hard phase is substituted by titanium carbide (TiC), tantalum carbide (TaC), titanium nitride (TiN), TiCN, and/or other hard ceramic materials (including double cemented ("DC") carbides and cellular structured [WC—Co]/Co composite materials, discussed below). However, limitations that will influence the effectiveness of the various elements in the general formula HP-Mm, is that (1) the material must be capable of being produced via LPS and (2) the material preferably forms an η phase which is similar or functionally equivalent to the η phase that is discussed above in conjunction with WC—Co material.

Furthermore, it should also be noted that the present method of forming graded materials may also be used and applied in conjunction with the manufacture of double cemented ("DC") carbides. DC carbides are known in the art and are outlined by U.S. Pat. No. 5,880,382, which prior patent is incorporated herein by reference. Additionally, the present method may further be used and applied in conjunction with the manufacture of cellular structured [WC—Co]/Co composite materials. Again, these cellular structured materials are known in the art and are explained in U.S. Pat. No. 6,063,502, which patent is incorporated herein by reference.

The present embodiments of the functionally graded materials may be used to manufacture cutting tools. Specifically, embodiments of the present functionally graded materials may be used to make components for metal machining cutters or rock drilling equipment (such as rock drilling cutters). Other potential commercial applications are, of course, also possible including punches, dies, components of rolling mills, mining equipment, wear parts, etc.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A method of forming a cemented tungsten carbide material in which the tungsten carbide is embedded in a cobalt matrix having a graded composition, comprising:

obtaining a sample of a cemented tungsten carbide material, the sample is a compact of powders having a first layer and a second layer, the first and second layer each containing a quantity of cobalt, wherein one of the layers is a carbon-deficient layer and the other layer is a carbon-enriched layer; and the overall carbon content including both layers is stoichiometic such that the molar amount of excess carbon in the carbon-enriched layer is substantially equal to the molar amount of deficient carbon-deficient layer such that when the material is sintered, the resulting material is neither carbon-deficient nor carbon-enriched;

sintering the powder compact under conditions which fully densifies the powder compact, and allows carbon atoms to diffuse from the carbon-enriched layer to the carbon-deficient layer and cause liquid cobalt to flow in the same direction as the carbon diffusion, thereby creating a gradient of cobalt in the sample, wherein there is no eta phase in the sintered products.

2. A method as in claim 1 wherein the carbon-deficient layer is created through the addition of excess tungsten powder.

3. A method as in claim 2 wherein the powder is formed by mixing and milling tungsten carbide (WC), cobalt (Co) and tungsten (W) powders according to the desired carbon deficient composition.

4. A method as in claim 1 wherein the carbon-enriched layer is created through the addition of excess carbon.

5. A method as in claim 4 wherein the carbon-enriched layer is formed by mixing and milling tungsten carbide (WC), cobalt (Co) and carbon powders according to desired carbon rich composition.

6. A method as in claim 1 wherein the amount of carbon in the carbon-deficient layer is sufficiently low to form η phase during sintering at high temperatures.

7. A method as in claim 1 wherein the sample is sintered between 1320° C. and 1500° C.

8. A method as in claim 1 wherein the quantity of cobalt metal in the first layer is either lower or greater than the quantity of cobalt in the second layer.

9. A method as in claim 1 wherein the quantity of cobalt metal in the first layer is equal to the quantity of cobalt in the second layer.

10. A method as in claim 1 wherein the sintering step comprises liquid phase sintering.

11. A method as in claim 1 wherein the tungsten carbide material includes amounts of tantalum carbide or titanium carbide.

* * * * *